US005687538A

United States Patent [19]

Frobosilo et al.

[11] Patent Number: 5,687,538

[45] Date of Patent: Nov. 18, 1997

[54] FLOOR JOIST WITH BUILT-IN TRUSS-LIKE STIFFNER

[75] Inventors: Raymond C. Frobosilo, Lido Beach; Ernest S. Viola, Huntington, both of N.Y.

[73] Assignee: Super Stud Building Products, Inc., Astoria, N.Y.

[21] Appl. No.: 388,290

[22] Filed: Feb. 14, 1995

[51] Int. Cl.[6] ..... E04C 3/07

[52] U.S. Cl. ..... 52/731.7; 52/100; 52/720.1; 52/731.1; 52/737.1

[58] Field of Search ..... 29/897.3, 897.35; 52/98, 100, 720.1, 731.1, 731.7, 731.8, 731.9, 733.2, 733.3, 737.1, 739.1

[56] References Cited

U.S. PATENT DOCUMENTS

| | | | |
|---|---|---|---|
| D. 157,994 | 4/1950 | Palmer | 52/737.1 X |
| 2,733,786 | 2/1956 | Drake | 52/733.2 X |
| 4,016,700 | 4/1977 | Blomstedt . | |
| 4,611,480 | 9/1986 | Willetts | 52/733.3 X |
| 4,709,519 | 12/1987 | Liefer et al. | 52/98 |
| 4,793,113 | 12/1988 | Bodnar | 52/733.2 X |
| 4,964,256 | 10/1990 | McCracken | 52/731.7 X |
| 5,157,883 | 10/1992 | Meyer | 52/731.9 X |
| 5,315,804 | 5/1994 | Attalla | 52/731.7 |

FOREIGN PATENT DOCUMENTS

| | | | |
|---|---|---|---|
| 2171731 | 9/1986 | United Kingdom . | |
| WO83/03811 | 11/1983 | WIPO . | |
| WO94/05872 | 3/1994 | WIPO | 52/731.7 |

OTHER PUBLICATIONS

PCT Intl Pub No. WO89/03920 May 5, 1989 Ingvarsson.

*Primary Examiner*—Carl D. Friedman
*Assistant Examiner*—Kevin D. Wilkens
*Attorney, Agent, or Firm*—Hugh D. Jaeger

[57] ABSTRACT

Floor joist fabricated of metal including a formed structure enhancing areas along and about a main planar web surface.

16 Claims, 9 Drawing Sheets

FLOOR JOIST WITH BUILT-IN TRUSS-LIKE STIFFNER

CROSS REFERENCES TO CO-PENDING APPLICATIONS

None.

BACKGROUND OF THE INVENTION

1. Field of the Invention

The present invention is for a building material component, and more particularly, pertains to a joist of reinforced construction to be used in the place of a wood joist.

2. Description of the Prior Art

Prior art joist devices have traditionally been of wooden material. Wooden joists present various problems. Bug infestation, such as by termites or the like, caused premature deterioration of a wooden joist especially in parts of the country which are conducive to rapid insect propagation. Damp and wet conditions also led to problems associated with wooden beams. Another factor associated with wooden beams is that of weight along the span of the joist.

Prior art metal joists have also exhibited poor sheer and torsional qualities.

The present invention provides a joist which overcomes the deficiencies of a prior art wooden or metal joist member.

SUMMARY OF THE INVENTION

The general purpose of the present invention provides a C-joist metal framing joist member including a reinforced main planar surface web member which is perpendicularly intersected by planar side members having inwardly extending lips. The reinforced main planar surface includes opposing parallel grooves or beads aligned parallel to the longitudinal axis and formed and depressed or embossed members aligned between the embossed groove members on the main planar web surface. The C-joist metal joist member is galvanized to preclude rusting and deterioration.

The present invention relates to a structural framing member with a C-shaped cross section comprising of a main planar surface and two planar side walls at right angles. The side walls present an inwardly turned lip formed substantially parallel to the base. The capacity of the metal framing joist sections is increased by embossing longitudinal stiffeners perpendicular to the top and bottom side walls, with a minimum depth of 0.01", continuous along the face of the main planar surface for the full length of the section. By bridging these longitudinal stiffeners with, but not limiting to, diagonal embossed stiffeners, a series of adjoining geometric shapes between longitudinal chords has been created to increase the rigidity of the web via adjoining geometric stiffeners which will carry the load by axial deformation rather than pure shear deformation. Local buckling capacity of the web, and top and bottom side walls, are increased and the bending stresses are more uniformly distributed along the member cross section. As a result, the floor joist with the built-in truss-like stiffener deflects less creating a more rigid floor system minimizing any spring or bounce action occasionally associated with metal framed floors.

The intersection of the center lines of the diagonal and/or vertical stiffeners with the longitudinal stiffeners are the panel points of the configuration, and the gravity axis of these deformations meet at the top and bottom panel points. Loads applied here will produce direct stress only. Any load applied to the member between the panel points will be distributed by beam action via the longitudinal section to the adjacent panel points. The overall effect of the embossed stiffeners increase the section properties of member elements and therefore increases the effective section properties.

The triangulation and other geometric shapes introduce a truss action in the main planar surface that direct forces from an imposed load to the stiffened areas of the main planar surface, hence a "truss" within a joist. The present invention is much more rigid than a typical C-joist in shear deformation and therefore will deflect less and support a greater load over a given span with sheet metal one or two gages lighter than a conventional C-joist. A structural framing member of the kind defined herein can be produced from a surprisingly thin sheet metal material that conforms to the structural criteria within the field of application.

Structure members find a wide variety of uses, especially in the residential housing market. One object of the present invention is, therefore, to provide a structure sheet metal member of the kind defined hereinbefore that can be produced from a surprisingly thin sheet metal material, and still meets all requirements for structure strengths reasonably to be expected within the field of application referred to hereinbefore. This means that the structure C-joist member with built-in truss-like stiffener shape not only compares with, but becomes entirely superior to framing timber, because it already inherently possesses desirable qualities such as a better dimensional stability, no tendency to warp, resistance to insects or rot, non-combustibility and a substantially higher durability provided the material has been properly treated to withstand corrosive attacks.

In order to reduce the deformation of members resulting from applied loads and stresses, it has been proposed, for example as described in PCT Application Publication No. 83/03811 to swage grooves into the webs of such members, and UK Application Publication No. 2171731A to swage webs at angles into the webs of such members.

However, such grooves as cited are not wholly effective in preventing distortion resulting from applied torsional stresses, and the minimization of the floor deflection. A structural member is now provided that has improved resistance to stress distortion, torsional stress distortion, minimized floor deflection, and to the buckling of a thin walled web.

From one aspect, therefore, the present invention provides a structural member have an open C-joist comprising a planer web member and side walls, wherein a forming or embossing truss-like stiffener upon the planar web member within the C-joist is formed along the longitudinal axis of the C-joist.

The truss-like stiffener embossing can be die stamped into the C-joist by a male and female steel die which can be powered by mechanical, air or hydraulic press. This can be done prior to forming the C-joist in a roll forming process. The truss-like stiffener embossing can also be rolled formed in the flat metal strip prior to roll forming the C-joist by means of synchronized hardened sheet rollers. Alternatively, one male steel roller and a female steel or synthetic roller can be utilized.

The two longitudinal beads or embossed groove members running the length of the C-joist that form the web of the truss-like stiffener within the C-joist can be rolled formed by means of steel forming rollers male and female, either in the forming of the C-joist tooling, or in combination with the synchronized steel hardened rollers to form the truss-like stiffener angular embossings.

According to one embodiment of the present invention, there is provided a reinforced metal joist member having a main planar web surface upon which are located opposing embossed groove members in between which are located depressed or embossed formed geometric reinforcement areas. Planar sides each having an inwardly extending planar lip member extend at right angles from the main planar web surface. The makeup of the joist members in combination forms a structure conforming to various nominally dimensioned joist members.

One significant aspect and feature of the present invention is a metal floor joist with a built-in truss-like stiffener. The metal floor joist which minimizes floor deflection and buckling of a thin walled web and in certain fields of application eliminates the need for commonly used web stiffeners, hence reducing the amount of materials in the application process resulting in both material and labor savings. By minimizing deflection, the present invention eliminates any spring or bounce action occasionally associated with metal framed floor systems. The metal floor joist which is light weight. The floor joist which is impervious to insects, bugs and live natural enemies. The floor joist which is impervious to rot. The floor joist which is galvanized. The metal floor joist having structural reinforcement areas along and about its length.

Another significant aspect and feature of the present invention is a metal floor joist having improved resistance to stress distortion and torsional stress distortion.

Yet another significant aspect and feature of the present invention is a metal floor joist structure exhibiting better dimensional qualities with consideration to environmental surroundings such as dampness and temperature.

Still another significant aspect and feature of the present invention is the incorporation of embossing, thereby adding support structure as well as providing for a high degree of sound deadening and vibration dampening as evidenced by a standard heel drop test known to the art.

A further significant aspect and feature of the present invention is a metal floor joist supplied with either prepunched access holes or a solid web with predesignated punching areas that can be easily removed to accommodate electrical cables, wiring, piping or any other such items.

Having thus described embodiments of the present invention, one object of the present invention is to provide a metal floor joist with an integral truss-like stiffener that will in its field of application and as a component in a building assembly, reduce the overall weight of the structure while maintaining a high degree of structural integrity that will ultimately be translated into a reduction of costs via materials and labor for the building industry as a whole.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
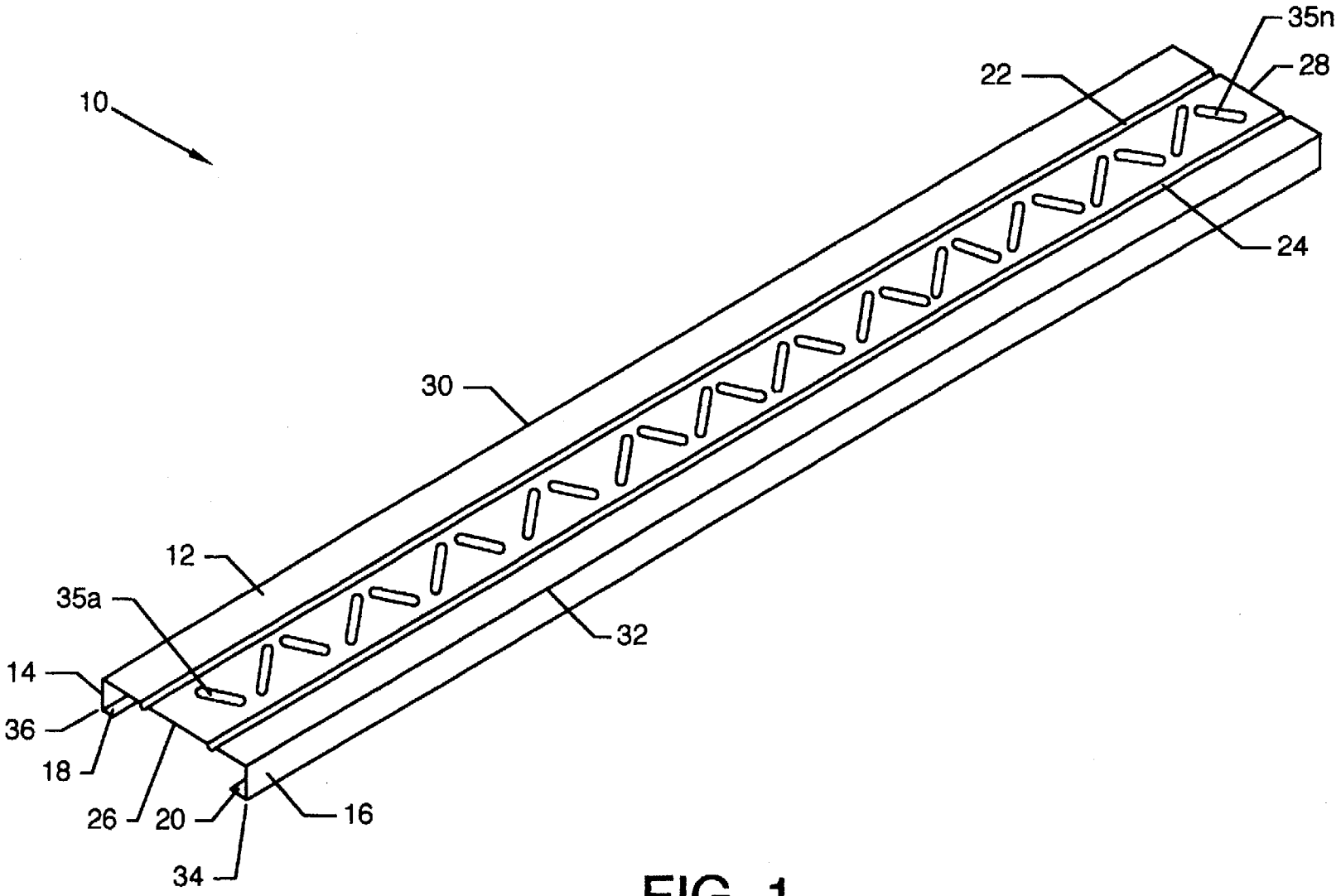
FIG. 1 illustrates a perspective view of a reinforced metal floor joist.

FIG. 1 illustrates a perspective view of a metal floor joist 10 of steel construction. The metal floor joist 10 includes a main planar surface 12 or web with opposing planar sides or flanges 14 and 16 extending perpendicularly from the main planar surface 12. Opposing planar lip members 18 and 20 align in planes which are parallel to the main planar surface or web 12 and extend inwardly and perpendicularly from the opposing planar sides 14 and 16 and bends 36 and 34, respectively. The dimensions of the metal floor joist 10 conform to those of nominally dimensioned joists commonly found in the housing and building industry, such as but not limited to, 2"×4", 2"×6", 2"×10", 2"×12", 2"×14" and the like. The main planar surface 12 includes various structure enhancing formed areas along and about the planar surface member 12 to provide for structural integrity such as for minimizing of flex and torsional forces. Parallel embossed grooves or beads 22 and 24 extend between the end edges 26 and 28 of the main planar surface 12 and parallel to the bended edges 30 and 32 of the main planar surface 12. A plurality of formed depressional or embossed members **35*a*–35*n* mutually align at approximately right angles to each other along the length of the main planar surface 12 and between the embossed grooves or beads 22 and 24 to enhance structural integrity. Although the depressional members 35*a*–35*n* are aligned essentially in a triangular configuration and one in the same general shape as a slotted hole, any shape such as a rectangle, a box, an "X" or other suitable geometric design can be incorporated. The surfaces of the joist 10** include a galvanized layer about the edges and surfaces to prevent rusting and general deterioration. In lieu of, or in combination with, other coatings such as plastic, epoxy or the like can be used to further prevent joist deterioration.

Figure 2:
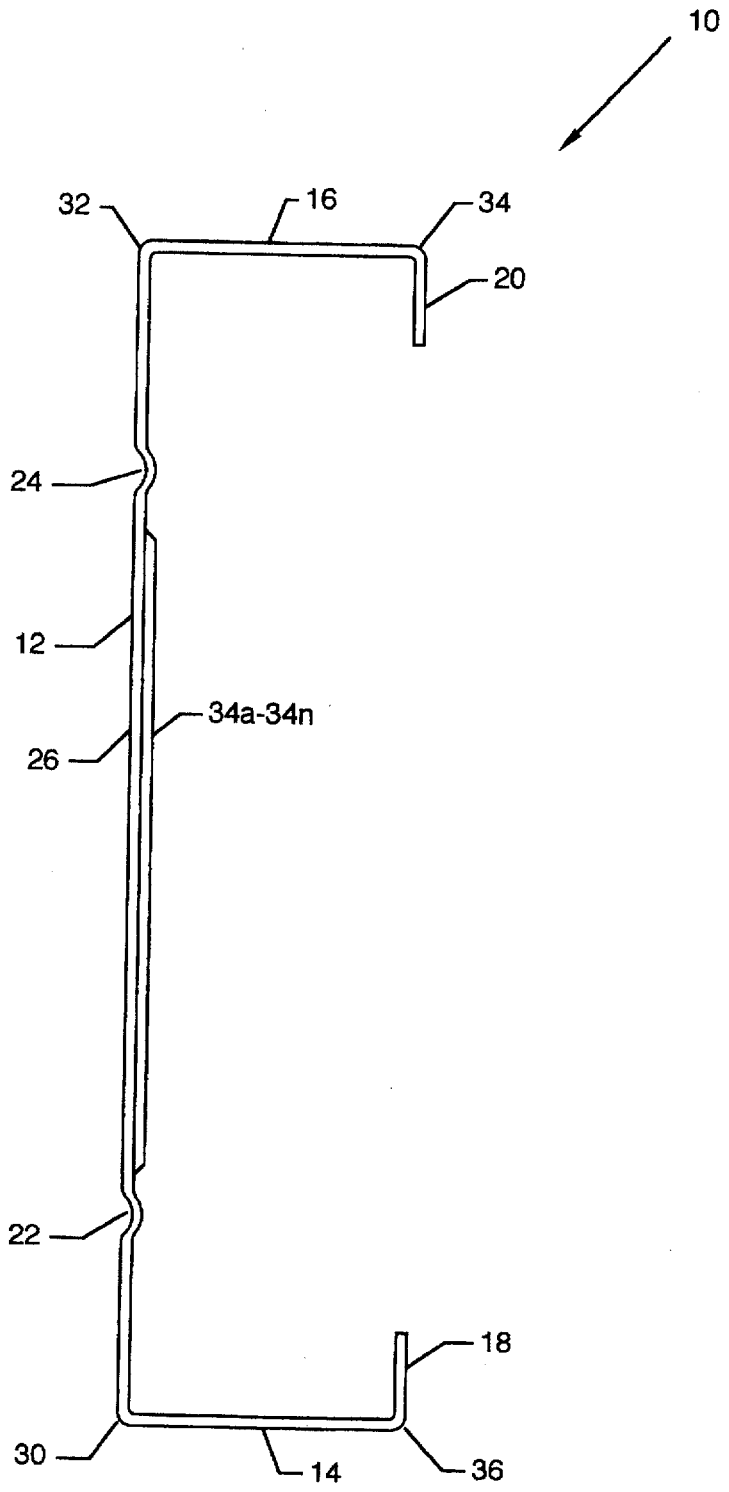
FIG. 2 illustrates an end view of the reinforced floor joist in vertical alignment.

FIG. 2 illustrates the metal floor joist 10 aligned in the vertical position such as in common use where all numerals correspond to those elements previously described. Also included in this FIG. 2 are bended edge 34 between the planar side 16 and planar lip member 20 and bended edge 36 between the planar side 14 and the planar lip member 18.

MODE OF OPERATION

Figure 3:
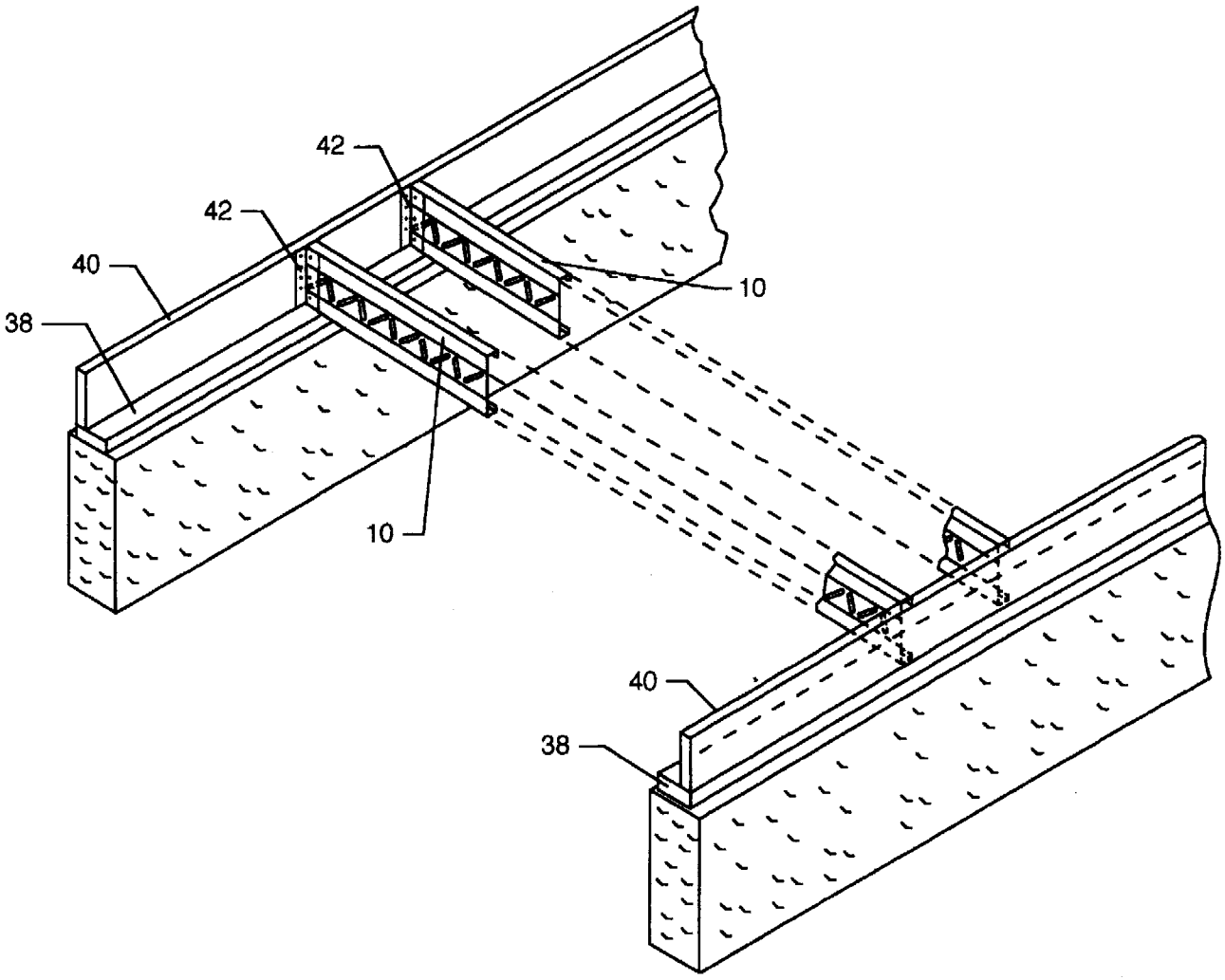
FIG. 3 illustrates one application of the present invention.

FIG. 3 illustrates one application of one or more metal floor joists 10 where all numerals correspond to those elements previously described the joist 10 rests on wood sills 38 and between end plates 40 which can be of wood or steel construction. The ends of the joist 10 are secured to the end plates 40 by the use of formed metal angle brackets 42 through which appropriate fastening hardware is used for securation.

DETAILED DESCRIPTION OF ALTERNATIVE EMBODIMENTS

Figure 4:
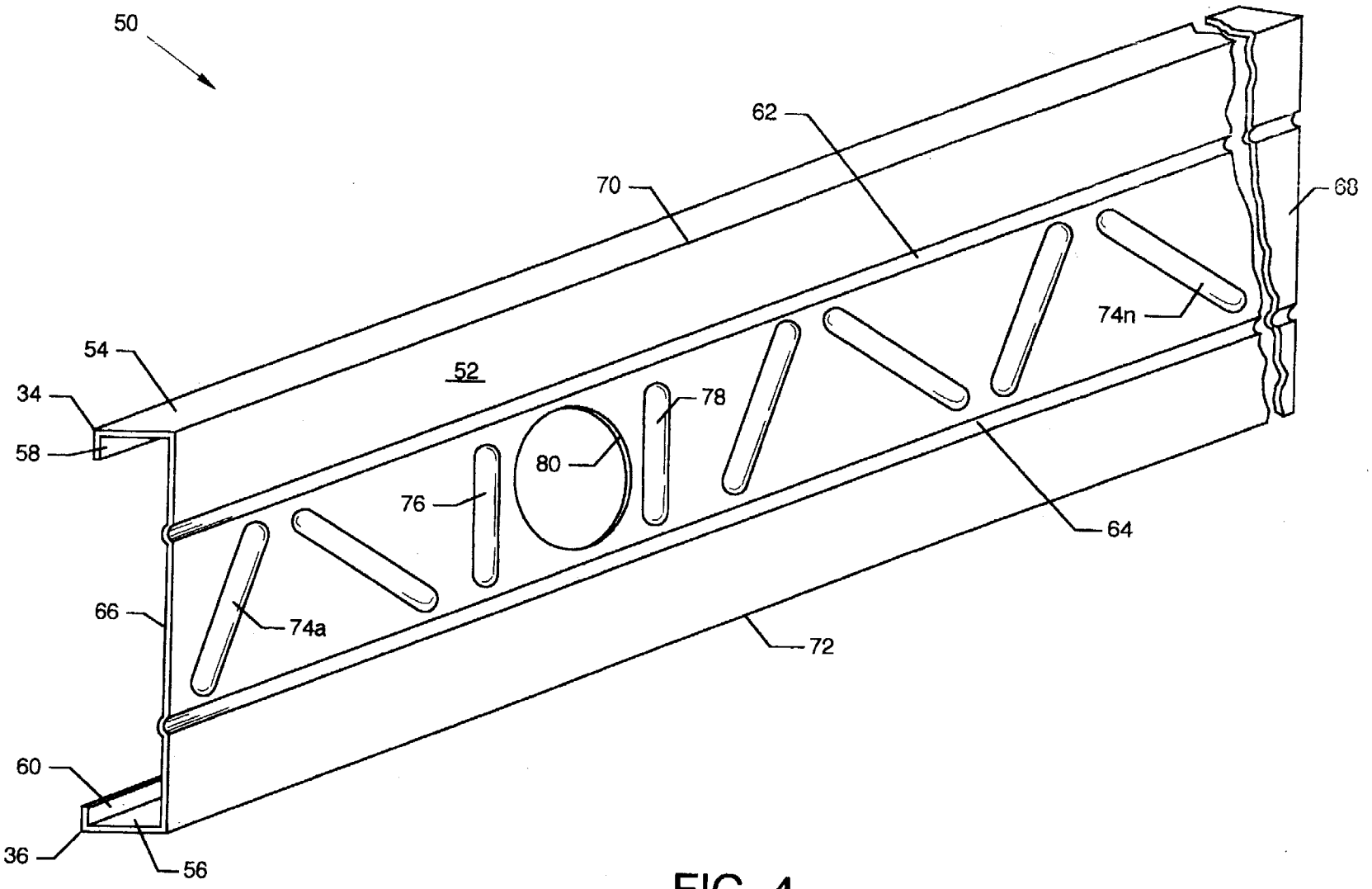
FIG. 4, a first alternative embodiment, illustrates a perspective view of a reinforced metal floor joist having an access hole and adjacent vertical depressional members.

FIG. 4, a first alternative embodiment, illustrates a perspective view of a metal floor joist 50 of steel construction. The metal floor joist 50 includes a main planar surface 52 or web with opposing planar sides or flanges 54 and 56 extending perpendicularly from the main planar surface 52 about bends 70 and 72. Opposing planar lip members 58 and 60 align in planes which are parallel to the main planar surface or web 52 and extend inwardly and perpendicularly from the opposing planar sides 54 and 56 and bends 34 and 36 respectively. The dimensions of the metal floor joist 50 conform to those of nominally dimensioned joists commonly found in the housing and building industry, such as but not limited to, 2"×4", 2"×6", 2"×10", 2"×12", 2"×14" and the like. The main planar surface 52 includes various structure enhancing formed areas along and about the planar surface member 52 to provide for structural integrity such as for minimizing of flex and torsional forces. Parallel embossed grooves or beads 62 and 64 extend between the end edges 66 and 68 of the main planar surface 52 and parallel to the bended edges 70 and 72 of the main planar surface 52. A plurality of formed depressional or embossed members **74*a*–74*n* mutually align at approximately right angles to each other and at 45° to the embossed grooves or beads 62 and 64 along the length of the main planar surface 52 and between the embossed grooves or beads 62 and 64 to enhance structural integrity. Also aligned, but at 90° to the embossed grooves or beads 62 and 64, are formed depressional or embossed symmetrical members 76 and 78 having a hole 80 aligned there between. The hole 80 and vertical embossed members 76 and 78 are spaced at intervals along the planar surface 52 and between appropriate members of the embossed or depressional members 74*a*–74*n*. A plurality of holes 80, reinforced by the adjoining vertical depressional members 76 and 78, accommodate electrical cables, wiring, piping or any other such items. The surfaces of the joist 50** include a galvanized layer about the edges and surfaces to prevent rusting and general deterioration. In lieu of, or in combination with other coatings such as plastic, epoxy or the like can be used to further prevent joist deterioration.

Figure 5:
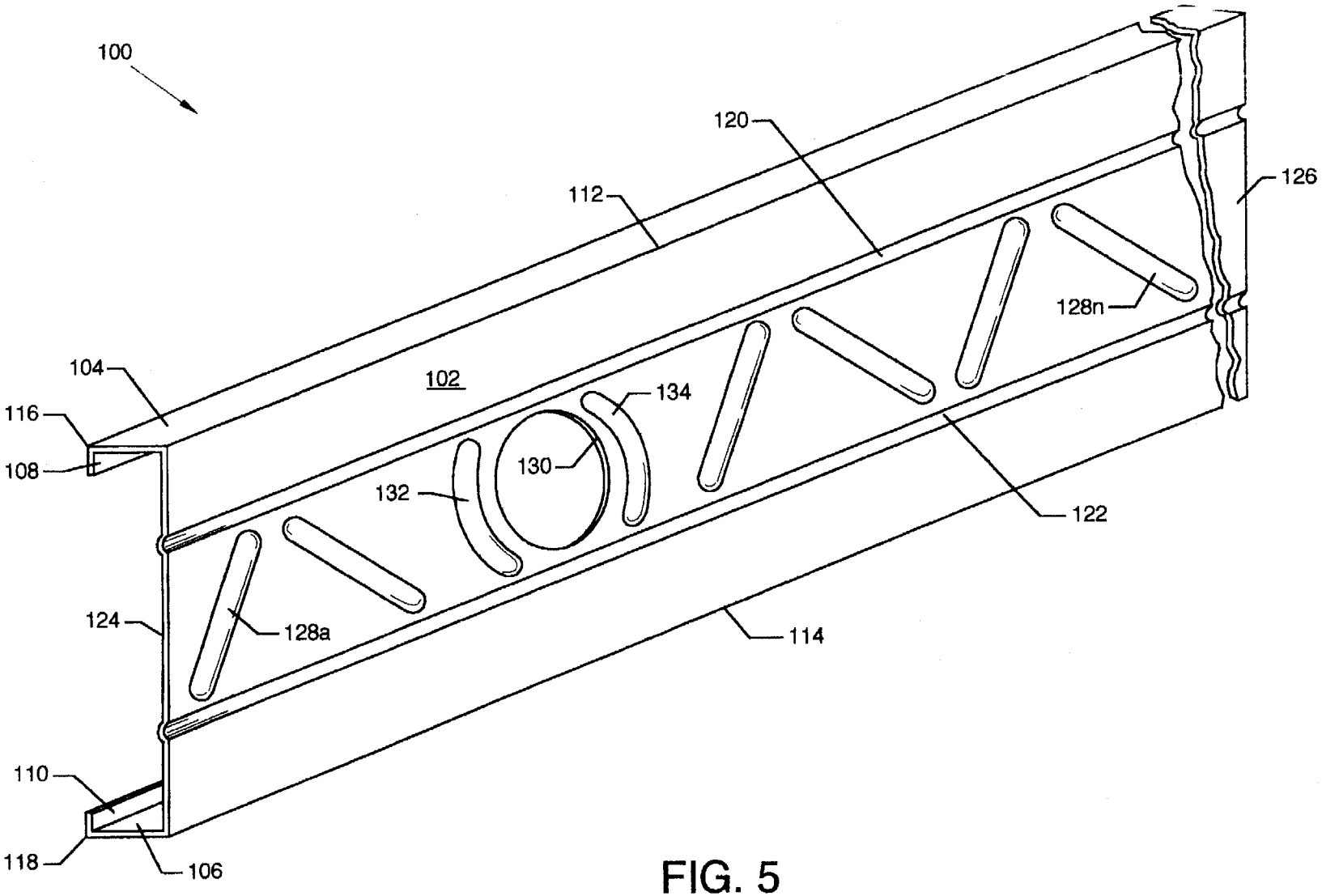
FIG. 5, a second alternative embodiment, illustrates a perspective view of a reinforced metal floor joist having an access hole and adjacent semi-circular depressional members.

FIG. 5, a second alternative embodiment, illustrates a perspective view of a metal floor joist 100 of steel construction. The metal floor joist 100 includes a main planar surface 102 or web with opposing planar sides or flanges 104 and 106 extending perpendicularly from the main planar surface 102 about bends 112 and 114. Opposing planar lip members 108 and 110 align in planes which are parallel to the main planar surface or web 102 and extend inwardly and perpendicularly from the opposing planar sides 104 and 106 and bends 116 and 118 respectively. The dimensions of the metal floor joist 100 conform to those of nominally dimensioned joists commonly found in the housing and building industry, such as but not limited to, 2"×4", 2"×6", 2"×10", 2"×12", 2"×14" and the like. The main planar surface 102 includes various structure enhancing formed areas along and about the planar surface member 102 to provide for structural integrity such as for minimizing of flex and torsional forces. Parallel embossed grooves or beads 120 and 122 extend between the end edges 124 and 126 of the main planar surface 102 and parallel to the bended edges 112 and 114 of the main planar surface 102. A plurality of formed depressional or embossed members **128*a*–128*n* mutually align at approximately right angles to each other and at 45° to the embossed grooves or beads 120 and 122 along the length of the main planar surface 102 and between the embossed grooves or beads 120 and 122 to enhance structural integrity. A plurality of holes 130 with flanking arced semi-circular depressional or embossed symmetrical members 132 and 134 align at intervals along the planar surface 102 spaced between depressional members 128*a*–128*n*. Hole 130, reinforced by the adjoining arcular depressional members 132 and 134, accommodates electrical cables, wiring, piping or any other such items. The surfaces of the joist 100** include a galvanized layer about the edges and surfaces to prevent rusting and general deterioration. In lieu of, or in combination with other coatings such as plastic, epoxy or the like can be used to further prevent joist deterioration.

Figure 6:
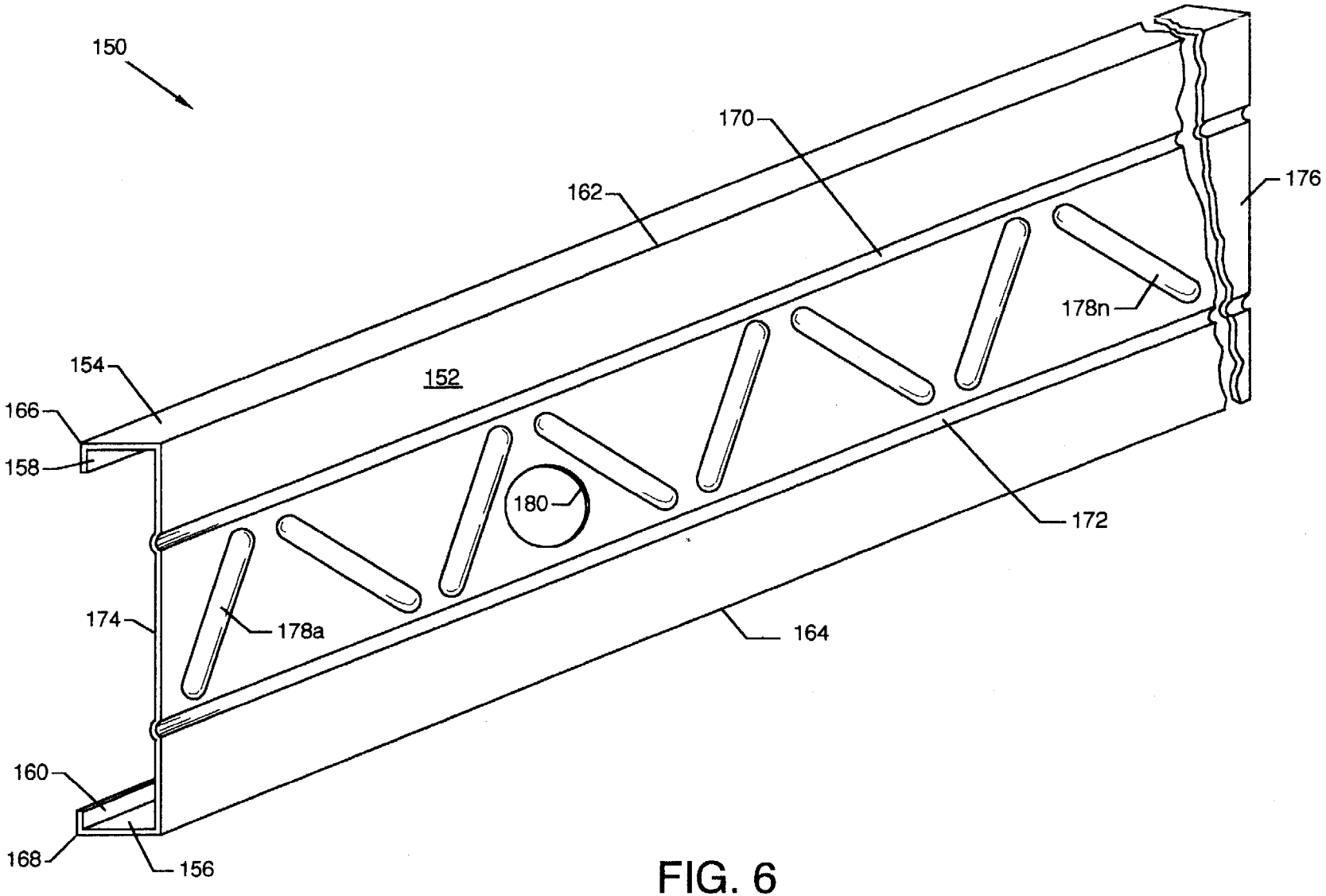
FIG. 6, a third alternative embodiment, illustrates a perspective view of a reinforced metal floor joist having an access hole adjacent to oblique reinforced depressional members.

FIG. 6, a third alternative embodiment, illustrates a perspective view of a metal floor joist 150 of steel construction. The metal floor joist 150 includes a main planar surface 152 or web with opposing planar sides or flanges 154 and 156 extending perpendicularly from the main planar surface 152 about bends 162 and 164. Opposing planar lip members 158 and 160 align in planes which are parallel to the main planar surface or web 152 and extend inwardly and perpendicularly from the opposing planar sides 154 and 156 and bends 166 and 168 respectively. The dimensions of the metal floor joist 150 conform to those of nominally dimensioned joists commonly found in the housing and building industry, such as but not limited to, 2"×4", 2"×6", 2"×10", 2"×12", 2"×14" and the like. The main planar surface 152 includes various structure enhancing formed areas along and about the planar surface member 152 to provide for structural integrity such as for minimizing of flex and torsional forces. Parallel embossed grooves or beads 170 and 172 extend between the end edges 174 and 176 of the main planar surface 152 and parallel to the bended edges 162 and 164 of the main planar surface 152. A plurality of formed depressional or embossed members **178*a*–178*n* mutually align at approximately right angles to each other and at 45° to the embossed grooves or beads 170 and 172 along the length of the main planar surface 152 and between the "V" grooves 170 and 172 to enhance structural integrity. A plurality of holes 180 align at intervals along the planar surface 152 spaced between adjacent depressional members 178*a*–178*n*. Holes 130 accommodate electrical cables, wires, piping or any other such items. The surfaces of the joist 150** include a galvanized layer about the edges and surfaces to prevent rusting and general deterioration. In lieu of, or in combination with other coatings such as plastic, epoxy or the like can be used to further prevent joist deterioration.

Figure 7:
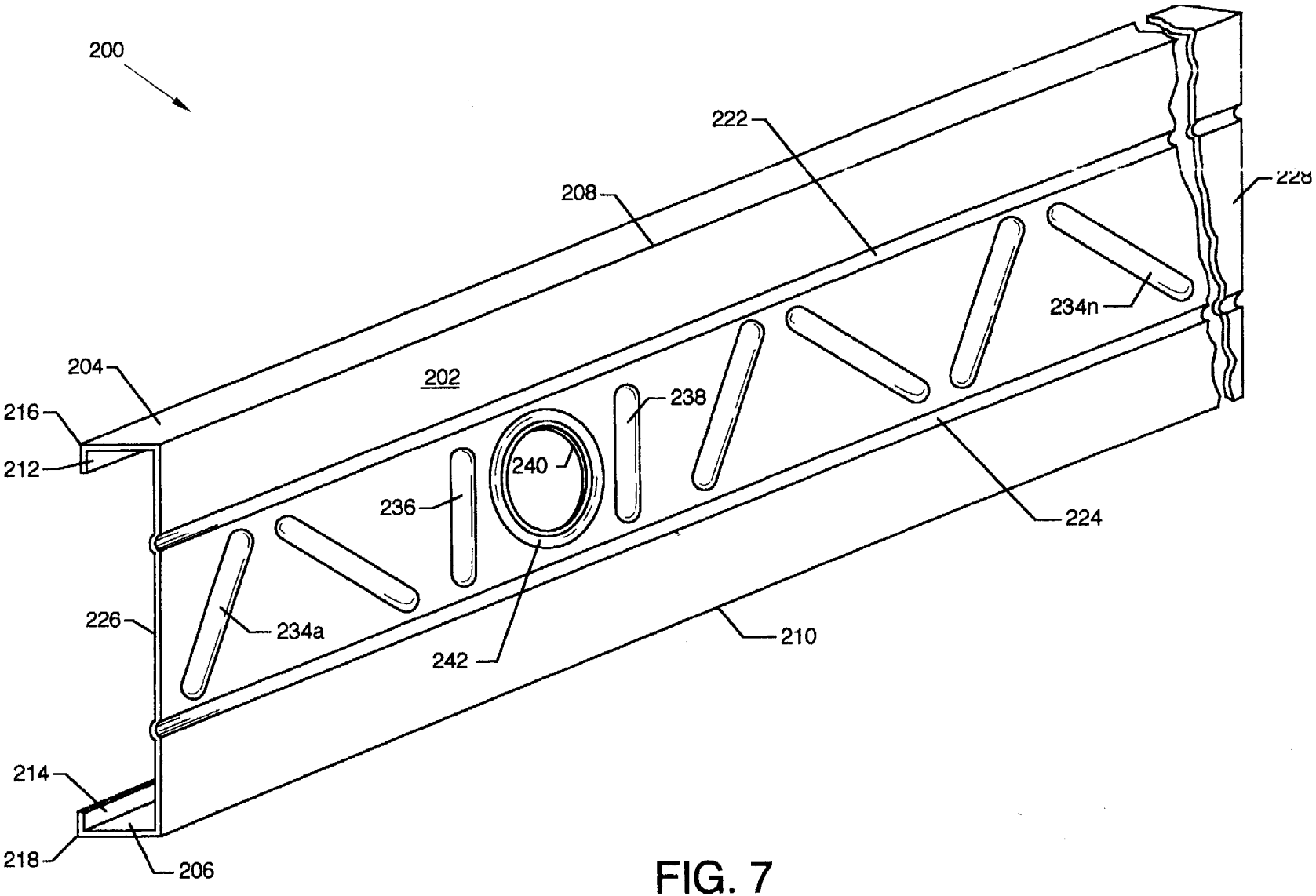
FIG. 7, a fourth alternative embodiment, illustrates a perspective view of a reinforced metal floor joist having an access hole concentrically surrounded by an annular depressional member.

FIG. 7, a fourth alternative embodiment, illustrates a perspective view of a metal floor joist 200 of steel construction. The metal floor joist 200 includes a main planar surface 202 or web with opposing planar sides or flanges 204 and 206 extending perpendicularly from the main planar surface 202 about bends 208 and 210. Opposing planar lip members 212 and 214 align in planes which are parallel to the main planar surface or web 202 and extend inwardly and perpendicularly from the opposing planar sides 204 and 206 and bends 216 and 218 respectively. The dimensions of the metal floor joist 200 conform to those of nominally dimensioned joists commonly found in the housing and building industry, such as but not limited to, 2"×4", 2"×6", 2"×10", 2"×12", 2"×14" and the like. The main planar surface 202 includes various structure enhancing formed areas along and about the planar surface member 202 to provide for structural integrity such as for minimizing of flex and torsional forces. Parallel embossed grooves or beads 222 and 224 extend between the end edges 226 and 228 of the main planar surface 202 and parallel to the bended edges 208 and 210 of the main planar surface 202. A plurality of formed depressional or embossed members 234*a*–234*n* mutually align at approximately right angles to each other and at 45° to the embossed grooves or beads 222 and 224 along the length of the main planar surface 202 and between the embossed grooves 222 and 224 to enhance structural integrity. Also aligned, but at 90° to the embossed grooves or beads 222 and 224, are opposing depressional symmetrical members 236 and 238 having a hole 240 concentrically surrounded by a reinforcement annular depressional member 242 spaced around the hole. The depressional members 236, 238, 242, and hole member 240 space at intervals along the planar surface 202 and appropriately between the angled depressional members 234*a*–234*n*. Holes 240 accommodate electrical cables, wires, piping or any other such items. The surfaces of the joist 200 include a galvanized layer about the edges and surfaces to prevent rusting and general deterioration. In lieu of, or in combination with other coatings such as plastic, epoxy or the like can be used to further prevent joist deterioration.

Figure 8:
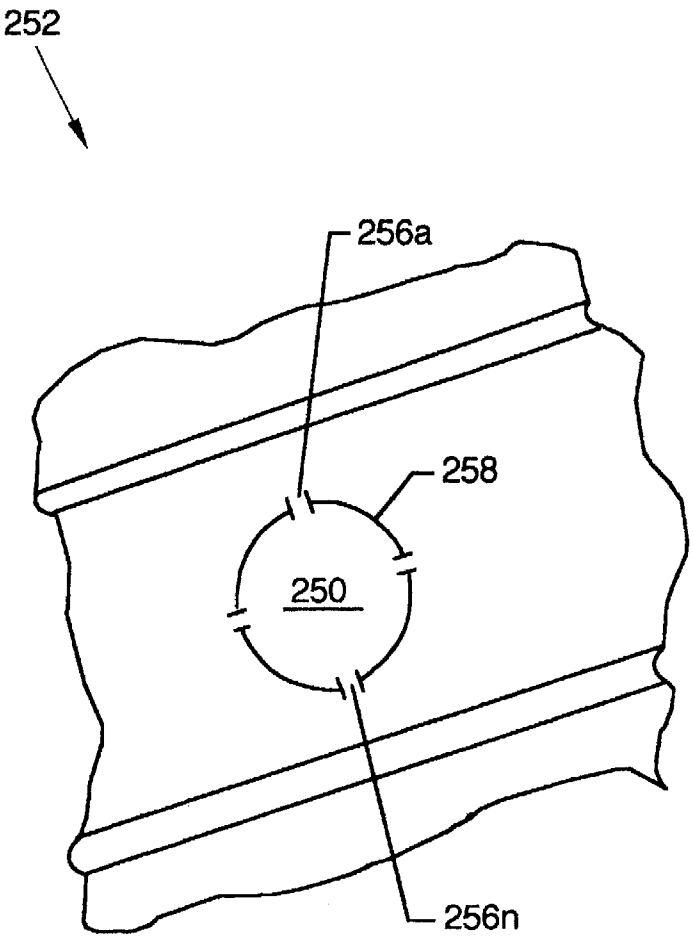
FIG. 8, a fifth alternative embodiment, illustrates a knockout hole slug which can be incorporated with reinforced metal floor joists; and, FIG. 9, a sixth alternative embodiment, illustrates a knockout hole slug incorporated with a surrounding annular depressional member.

FIG. 8, a fifth alternative embodiment, illustrates a knockout hole slug 250 which can be incorporated in a portion of a reinforced metal floor joist 252 consistent with the teachings of the invention and such as those previously described. The knockout hole slug 250 is supported in a hole 258 by one or more frangible tabs 256*a*–256*n* bridging the knockout hole slug 250 to the area immediately adjacent to hole 258. Sheer support is offered by a plurality of knockout hole slugs 250 aligned along the length of the metal floor joist 252 aligned along the length of the metal floor joist 252 consistent with the teachings of the invention by itself and in combination with adjacent depressional members such as described in the previous FIGS.

Figure 9:
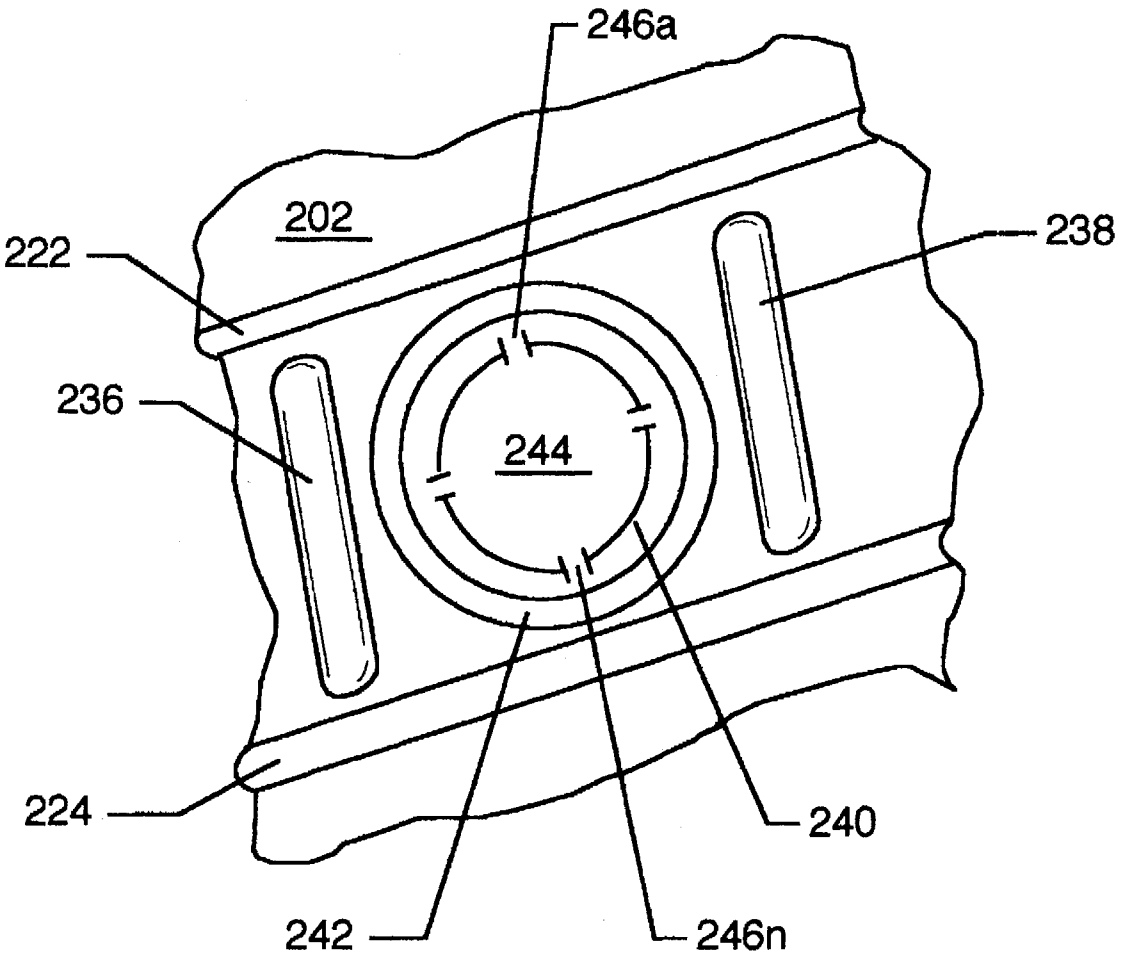

FIG. 9, a sixth alternative embodiment, illustrates a portion of the reinforced metal floor joist 200 of FIG. 7 incorporating a knockout hole slug 244 supported in the hole 240 where all numerals correspond to those elements previously described. The knockout hole slug 244 is supported in the hole 240 by one or more frangible tabs 246*a*–246*n* bridging the knockout hole slug 244 to the area immediately adjacent to the hole 240. Sheer support is offered by a plurality of knockout hole slugs 244 aligned along the length of the metal floor joist 200 consistent with the teachings of the invention by itself and in combination with adjacent depressional members such as described in the previous FIGS. Incorporation of the knockout hole slug 244 in combination with a concentrically aligned annular depressional member 242 and adjacent depressional members, such as members 236 and 238, provides for maximum sheer support and strength.

Various modifications can be made to the present invention without departing from the apparent scope hereof.

We claim:

1. A joist with a built-in truss-like stiffener, comprising:

an elongated metallic member having a C-shaped cross section composed of a web, two sides extending at right angles from said web in the same direction from said web, and two lips extending toward each other from said two sides; two spaced apart, parallel embossed beads formed in said web and extending the full length of said web; a series of discrete embossed beads formed in said web between said two spaced apart, parallel embossed beads, said discrete embossed beads being arranged in a zig-zag pattern along the entire length of said web and being entirely free from contact with said two spaced apart, parallel embossed beads; at least one pair of additional embossed beads formed in said web between said two spaced apart, parallel embossed beads and between two adjacent ones of said series of discrete embossed beads, said additional embossed beads oriented differently than said two adjacent ones of said series of discrete embossed beads; and a hole through said web located between said at least one pair of additional embossed beads.

2. A joist with a built-in truss-like stiffener, comprising:

a. an elongated metallic member having a C-shaped cross section formed of a main planar web, opposing planar sides extending perpendicularly from said main planar web in the same direction from said main planar web and parallel to each other, and opposing lip members extending from said planar sides toward each other;

b. longitudinal stiffeners formed in said main planar web, each longitudinal stiffener extending continuously along the full length of said main planar web in spaced apart and parallel relationship to one another;

c. a truss-like stiffener built into said main planar web, said truss-like stiffener comprising a series of depressional members formed in said main planar web between said longitudinal stiffeners, said depressional members extending at approximately right angles to each other and at approximately forty-five degree angles to said longitudinal stiffeners;

d. at least one pair of additional depressional members formed in said main planar web between said longitudinal stiffeners and between two adjacent ones said series of depressional members, said additional depressional members oriented differently than said two adjacent ones of said series of depressional members; and, e. a hole through said main planar web located between said at least one pair of additional depressional members.

3. A joist with a built-in truss-like stiffener in accordance with claim 2, wherein each of said lip members is planar and said lip members align with each other in a plane parallel to said main planar web.

4. A joist with a built-in truss-like stiffener in accordance with claim 2, wherein each longitudinal stiffener comprises a continuous groove formed in said main planar web.

5. A joist with a built-in truss-like stiffener in accordance with claim 2, wherein each depressional member is constituted of a groove formed in one surface of said main planar web and a corresponding bead raised on the opposite surface of said main planar web.

6. A joist with a built-in truss-like stiffener in accordance with claim 2, wherein each additional depressional member is linear and extends at right angles to said longitudinal stiffeners.

7. A joist with a built-in truss-like stiffener in accordance with claim 2, wherein each additional depressional member is arcuate.

8. A joist with a built-in truss-like stiffener in accordance with claim 2, wherein said hole is concentrically surrounded by an annular depressional member located between said at least one pair of additional depressional members between which said hole is located.

9. A joist with a built-in truss-like stiffener in accordance with claim 2, wherein said depressional members are spaced from one another and from said longitudinal stiffeners.

10. A joist with a built-in truss-like stiffener, comprising:

a. an elongated metallic member having a C-shaped cross section formed of a main planar web, opposing planar sides extending perpendicularly from said main planar web in the same direction from said main planar web and parallel to each other, and opposing planar lip members extending perpendicularly from said planar sides toward each other and aligning in a plane parallel to said main planar web;

b. two longitudinal stiffeners formed in said main planar web, each longitudinal stiffener comprising a continuous groove formed in said main planar web and extending along the full length of said main planar web, said continuous grooves being spaced apart and lying parallel to each other;

c. a truss-like stiffener built into said main planar web between said spaced apart, parallel, continuous grooves, said truss-like stiffener comprising a series of discrete depressional members extending along the full length of said main planar web, each discrete depressional member being constituted by a groove depressed into one surface of said main planar web which creates a corresponding bead raised from the opposite surface of said main planar web, said discrete depressional members extending at approximately right angles to each other and at approximately forty-five degree angles to said spaced apart, parallel, continuous grooves;

d. each discrete depressional member being spaced from one another and from each of said spaced apart, parallel, continuous grooves; and e. a hole through said main planar web, said hole being flanked by two additional depressional members located between said spaced apart, parallel, continuous grooves and between two adjacent ones of said series of discrete depressional members, said additional depressional members oriented differently than said two adjacent ones of said series of discrete depressional members.

11. A joist with a built in truss-like stiffener in accordance with claim 10 wherein each of said two additional depressional members is oriented at approximately right angles to said spaced apart, parallel, continuous grooves.

12. A joist with a built-in truss-like stiffener in accordance with claim 10, wherein each of said two additional depressional members has an arcuate shape.

13. A joist with a built-in truss-like stiffener in accordance with claim 10, wherein each of said two spaced apart, parallel, continuous grooves is formed by a depression in one surface of said main planar web which creates a corresponding bead raised from the opposite surface of said main planar web.

14. A joist with a built-in truss-like stiffener in accordance with claim 13, wherein said depressions forming said spaced apart, parallel, continuous grooves are both formed in the same surface of said main planar web.

15. A joist with a built-in truss-like stiffener, comprising:

a. an elongated metallic member having a C-shaped cross section formed of a main planar web, opposing planar sides extending perpendicularly from said main planar web in the same direction from said main planar web and parallel to each other, and opposing lip members extending from said planar sides toward each other;

b. longitudinal stiffeners formed in said main planar web, each longitudinal stiffener extending continuously along the full length of said main planar web in spaced apart and parallel relationship to one another;

c. a truss-like stiffener built into said main planar web, said truss-like stiffener comprising a series of depressional members formed in said main planar web between said longitudinal stiffeners, said depressional members extending at approximately right angles to each other and at approximately forty-five degree angles to said longitudinal stiffeners;

d. at least one pair of additional depressional members formed in said main planar web between said longitudinal stiffeners and between two adjacent ones of said series of depressional members, said additional depressional members oriented differently than said two adjacent ones of said series of depressional members; and, e. a knockout slug formed in said main planar web between said at least one pair of additional depressional members, said knockout slug being capable of being knocked out to create a hole through said main planar web between said at least one pair of additional depressional members.

16. A joist with a built-in truss-like stiffener in accordance with claim 15, wherein said knockout slug is concentrically surrounded by an annular depressional member.

* * * * *